US006804904B2

(12) United States Patent
Garcia

(10) Patent No.: US 6,804,904 B2
(45) Date of Patent: Oct. 19, 2004

(54) COTTON COLLECTION TRAILER MOBILE SIGN

(76) Inventor: Felipe Garcia, 222 W. University Dr., Edinburg, TX (US) 78539

( * ) Notice: Subject to any disclaimer, the term of this patent is extended or adjusted under 35 U.S.C. 154(b) by 0 days.

(21) Appl. No.: 10/059,281

(22) Filed: Jan. 29, 2002

(65) Prior Publication Data

US 2003/0140538 A1 Jul. 31, 2003

(51) Int. Cl.[7] ..... G09F 21/04
(52) U.S. Cl. ..... 40/590
(58) Field of Search ..... 40/590, 603, 601

(56) References Cited

U.S. PATENT DOCUMENTS 2,029,908 A * 2/1936 Bleecker ..... 40/624
3,280,521 A * 10/1966 Keathly ..... 40/624
3,702,033 A * 11/1972 Coleman ..... 40/590
3,798,814 A * 3/1974 Harmon ..... 40/590
5,507,109 A * 4/1996 Rinzler ..... 40/603
6,119,384 A * 9/2000 Fischer ..... 40/590

* cited by examiner

*Primary Examiner*—Gary Hoge
(74) *Attorney, Agent, or Firm*—Michael B. Jolly

(57) ABSTRACT

A mobile sign is adapted from discarded cotton collection trailers. The cotton collection trailers include a front steering axle and trailing rear axle supporting a horizontal rectangular frame. The rectangular cotton collection cage mounted to the trailer is removed and replaced with an upright vertical rectangular frame which supports sign material. The modifications to unused and discarded cotton collection trailers provides a useful purpose for the trailers and prevents the waste of selling the trailers for scrap. The trailers are easily pulled to desired locations utilizing the existing tow bar and can be secured by deploying outriggers or extendable feet, removing the tires from the trailer, and securing the trailer to a ground anchor. The mobile sign will support numerous types of sign material, including border grommeted canvas and board material.

1 Claim, 3 Drawing Sheets

COTTON COLLECTION TRAILER MOBILE SIGN

TECHNICAL FIELD

The present invention relates to mobile signs and more particularly to a mobile sign adapted from an abandoned cotton collection trailer. The mobile sign framework supports changeable sign media while the sign may be easily moved to desirable locations and secured in place.

BACKGROUND ART

For years cotton harvesting utilized cotton collection trailers which were pulled next to cotton picking equipment. When the collection trailer became full it was pulled, at low speed, to the cotton gin, emptied and returned to the field for another trip. Recently this method has been replaced with a so called "module" system. The module system uses a compactor stationed in the field which presses the picked raw cotton into large rectangular modules. After the field has been picked the modules are transported to the gin using a specially designed module truck. The shift to the module system has resulted in thousands of cotton collection trailers sitting idle and unused. The inventor has found that with minor modifications the cotton collection trailers may be adapted for use as a mobile sign. The cotton collection trailers were all built with a rectangular sub frame which supports a cotton collection cage which is carried by a steering front axle with a tow bar that connects to a tractor or truck. No suspension is provided on the axles thereby limiting the use of the trailers on the roadway but not limiting the use of the trailers as a support for a sign as the present invention. The cage for collecting the cotton is removed and replaced with a vertically positioned rectangular frame for supporting a sign. The sign is easily and conveniently moved to desirable locations to provide maximum visibility of the sign. The sign is secured in place by removing the tires and extending feet on the outside perimeter of the trailer frame, or by the deployment of outriggers and then securing the trailer to ground anchors.

GENERAL SUMMARY DISCUSSION OF INVENTION

It is thus an object of the invention to provide a mobile sign which is adapted from a modified cotton collection trailer, wherein the cotton collection cage is removed form the trailer and replaced with a vertical sign support frame, the vertical sign support frame is securely attached to the horizontal rectangular trailer frame and includes an internal dimension which will easily receive a canvas sign with grommets on outside edges so that a rope or line can be utilized to tightly fasten the sign to the frame with both sides of the sign visible.

It is intended that an object of the invention is to provide a mobile sign which is easily transported to a desirable location and easily secured in place by removing the trailer tires, extending a pair of outrigger feet to contact the ground and anchoring the trailer to ground anchors.

It is a further object of the invention to provide a mobile sign capable of supporting sign material such as canvas and other material used for outdoor signage within a framework and wherein the sign material is easily installed by one person and may be easily changed and moved as needed.

DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
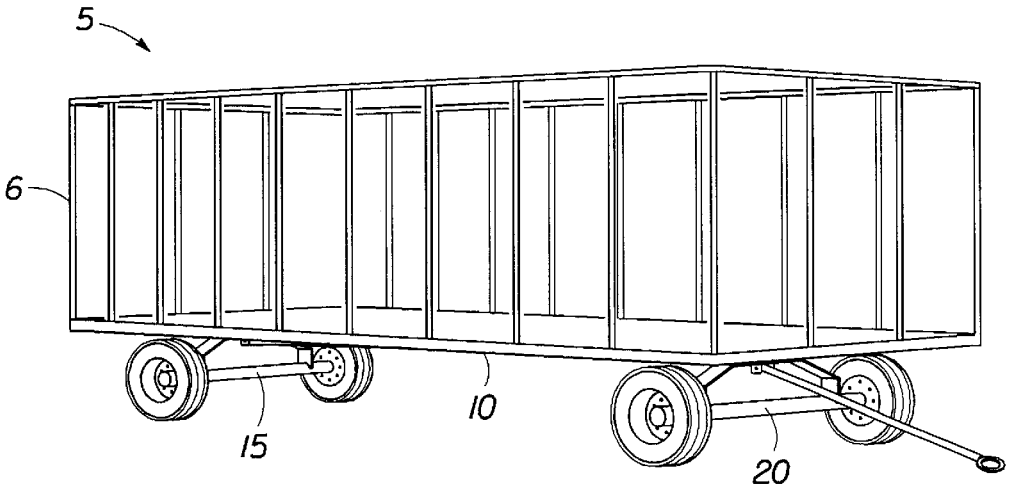
Fig. 1 (PRIOR ART)
FIG. 1 is a perspective view of a cotton collection trailer, from which the mobile sign described and claimed herein is constructed.

The mobile sign described and claimed is constructed from abandoned cotton collection trailer 5 such as that illustrated in FIG. 1. The cotton collection cage 6 which was used to collected cotton in the field during harvest is removed and discarded. A horizontal trailer frame 10, along with a steering front axle 15, trailing rear axle 20, and tow bar 30 are retained and utilized in the construction of the mobile sign 40, which is illustrated in different angles and embodiment in FIGS. 2–5.

Figure 2:
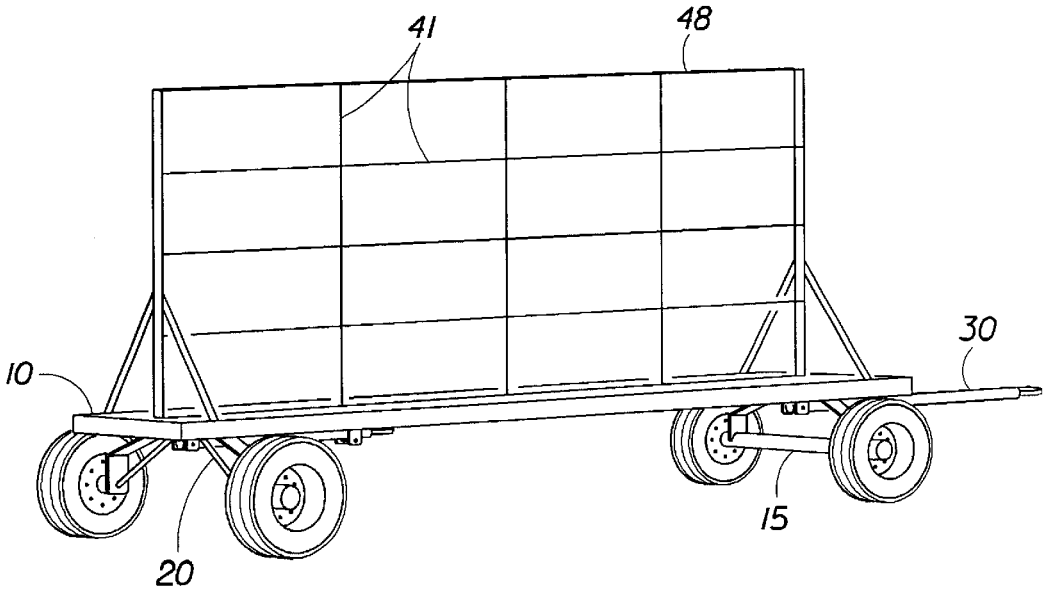
FIG. 2 is a perspective rear view of a mobile sign adapted from a cotton trailer with vertical sign support frame installed thereon.
Figure 3:
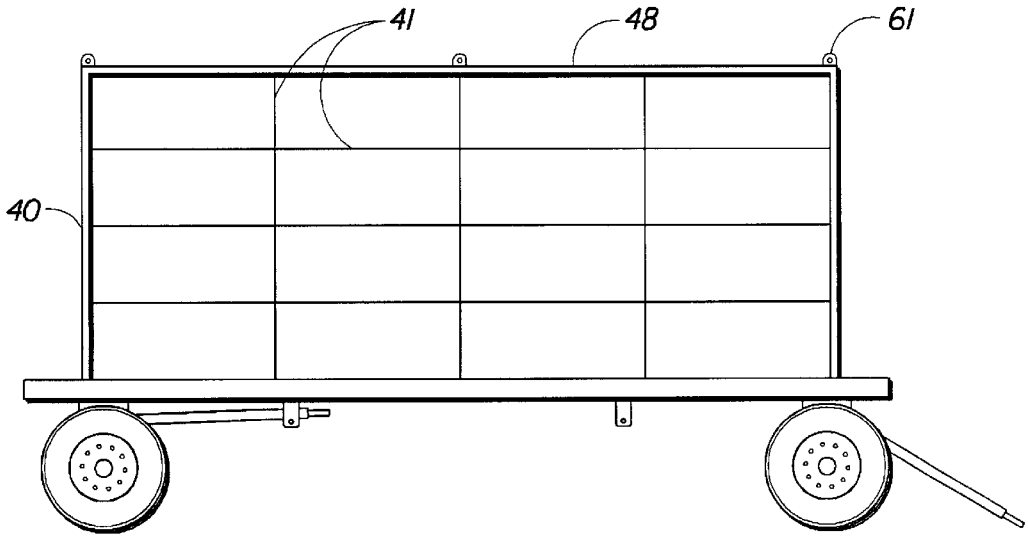
FIG. 3 is a side view of a mobile sign adapted from a cotton collection trailer with vertical sign support frame installed thereon.
Figure 4:
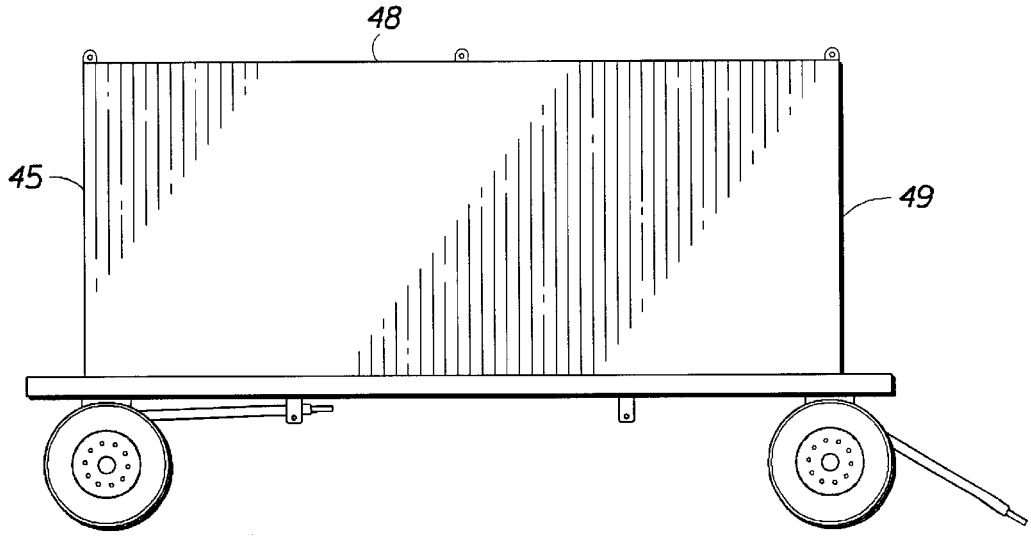
FIG. 4 is a side view of a mobile sign adapted from a cotton collection trailer with vertical support frame with an open interior installed thereon.

A vertical sign support frame structure 40 is illustrated in FIG. 2 in a perspective view from the rear of the mobile sign and may include internal support members 41 which extend and interconnect both vertically and horizontally within an interior of the perimeter frame members of the frame structure 40. FIG. 4 illustrates an open interior vertical sign support frame structure 45 with no vertical and horizontal interconnecting members, as in FIG. 2. The open interior vertical sign support frame structure supports two sided sign material without affecting the visibility of the sign from either side, while the vertical frame with interior supports requires sign material to be installed either on one side or the other or on both sides of the frame.

The exterior dimensions of the vertical frame are about 124 inches high and about 244 inches long while the interior dimensions of the frame are about 120 inches high and about 240 inches long. The frame members are preferably constructed of 2 inch square tubing and welded at the joints. Grommets 47 of about ⅜ inches in diameter, spaced 22 inches apart on the horizontal frame member 48, and spaced 21 inches apart on the vertical frame members 49, with a identical spacing of grommets 51 on the horizontal 52 and vertical edges 53 of the sign material 50. A line or rope 60 is looped through the grommets 47 on the frame members and the grommets on the sign material 51 the cinched tight to secure the sign material to the frame.

Figure 5:
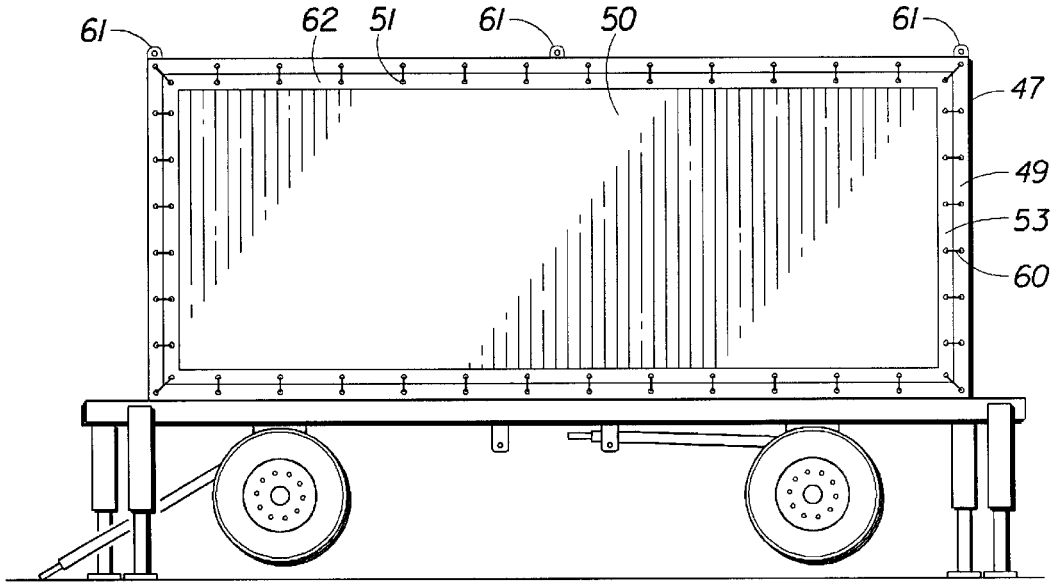
FIG. 5 is a side view of a mobile sign adapted from a cotton collection trailer with sign material installed on the vertical sign support frame and outriggers extending from the trailer frame for lateral support of the trailer.

The sign material 50 is preferably vinyl or canvass or some other suitable non stretching material with signage information imprinted thereon. Installation of the sign material is eased by rope loops 61 positioned on the top edge of each end of the top horizontal frame member. A rope loops through the loop 61 with one attached to the sign material while it is pulled upwardly to the top of the frame for securing with rope 60 through the grommets. A loop 61 may also be placed about midway between the end on the top edge as illustrated in FIG. 5.

The sign is secured in place by an assortment of features including outriggers 70, tie-downs 80 and removal of the trailer tires. The outriggers 70 include a pair of extendable feet 71 or foldable members extending horizontally from the trailer frame and on opposing sides, there may be two or more on each trailer for providing lateral support of the mobile sign during heavy winds. The tie-downs 80 are flexible or solid and extend from the trailer frame to an anchor 81 secured in the ground. A typical tie-down suitable for use would be the tie-downs used for mobile homes and trailers with an auger type anchor which screws into the ground to which the tie-down is attached and tightened.

It is noted that the embodiment of the cotton collection trailer mobile sign described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

I claim:

1. A mobile sign manufactured from a cotton collection trailer with two front wheels attached to two steering axles and two rear wheels attached to a rear trailing axle, a tow bar connected to the front steering axles, a rectangular horizontally orientated frame structure connecting the front and rear axles with the long edge of the rectangle frame structure extending between the front and rear wheels and wherein a cotton collection cage has been removed from the cotton collection trailer, comprising:

a) a rectangular vertical frame structure positioned on a top side of the rectangular horizontal frame structure and about midway between each front wheel and about midway between each rear wheel, b) a pair of extendable feet slidably attached to opposing sides of the horizontal frame structure wherein the extendable feet extend downwardly from the horizontal frame structure in contact with the ground, c) a means for securing the mobile sign to a tie down anchor to prevent the sign from toppling during heavy winds, d) wherein the rectangular vertical frame further comprises perimeter frame members forming the rectangular vertical frame with an open interior and wherein the open interior is dimensioned to receive flexible sign material within the interior dimension, and e) wherein the vertical frame member further comprises two eyelets positioned on opposing ends of a top edge of the perimeter frame members wherein the eyelets are utilized for guiding a line through when raising and spreading a sign in the open interior of the vertical frame member.

* * * * *